US006923675B2

(12) United States Patent
Gorin

(10) Patent No.: US 6,923,675 B2
(45) Date of Patent: Aug. 2, 2005

(54) COLOR CODED TELEPHONE PLUG RECEPTACLE

(76) Inventor: Thomas Michael Gorin, 2125 Virginia Pl. NE., Atlanta, GA (US) 30305

( * ) Notice: Subject to any disclaimer, the term of this patent is extended or adjusted under 35 U.S.C. 154(b) by 406 days.

(21) Appl. No.: 10/028,506

(22) Filed: Dec. 20, 2001

(65) Prior Publication Data

US 2004/0127089 A1 Jul. 1, 2004

Related U.S. Application Data

(60) Provisional application No. 60/325,036, filed on Sep. 26, 2001.

(51) Int. Cl.[7] ..... H01R 3/00
(52) U.S. Cl. ..... 439/491; 439/536
(58) Field of Search ..... 439/498, 491, 439/676, 535, 536

(56) References Cited

U.S. PATENT DOCUMENTS

| | | | | |
|---|---|---|---|---|
| 4,214,132 A | * | 7/1980 | Kelso | 439/676 |
| 4,704,091 A | * | 11/1987 | Owens et al. | 439/491 |
| 4,820,193 A | * | 4/1989 | Noorily | 439/488 |
| 5,357,051 A | | 10/1994 | Hwang | 174/33 |
| 5,432,484 A | | 7/1995 | Klas et al. | 333/1 |
| 5,673,009 A | | 9/1997 | Klas et al. | 333/1 |
| 5,775,935 A | * | 7/1998 | Barna | 439/491 |
| 5,885,111 A | | 3/1999 | Yu | 439/676 |
| 5,941,734 A | | 8/1999 | Ikeda et al. | 439/676 |
| 6,042,419 A | | 3/2000 | Liu | 439/557 |
| 6,086,414 A | | 7/2000 | Tipton et al. | 439/540.1 |
| 6,132,266 A | | 10/2000 | Klas et al. | 439/894 |
| 6,161,278 A | * | 12/2000 | Easter et al. | 29/749 |

OTHER PUBLICATIONS

"Modular Jack Styles," SESCO Data Systems Web page www.sescodatasystems.com, 5 pages, Jun. 4, 2001.

Global Technologies Inc.—www.globaltec.com, 100 Ohm UTP Cabling Systems, 5 pages; Plug Wiring Reference, 2 pages; 66 and 110 Block Wiring, 2 pages; Modular Jack Wiring USOC Configurations, 2 pages; Modular Jack Wiring TIA/EIA–568–A Configurations, 1 page; Modular Jack Wiring LAN Configurations, 1 page.

"Weeno: How to Install a Second Phone Line Yourself" Category: Home and Apartments: Do It Yourself and Repairs, by Arnold Kim, Weeno web page www.weeno.com, 6 pages May 31, 2001.

BICSI—New Fcc Wiring Standard Set, by Michael Chotiner, 1 page, Feb. 15, 2000.

* cited by examiner

*Primary Examiner*—Tho D. Ta
(74) *Attorney, Agent, or Firm*—Thomas, Kayden, Horstemeyer & Risley, LLP

(57) ABSTRACT

A telephone plug receptacle assembly 8 includes conductors 35–38 bearing the colors that match the colors of the color code of the wires 25–28 of a cable, such as category 3 or category 5 telephone cable. The junctions 31–34 that connect the cable wires to the assembly are color coded to match the colors of a second type of cable, such as station wire. The junctions can be screws of different colors or the color identifications can be directly applied to the mounting block 13 adjacent each junction. The color identifications on the mounting block can be the colors themselves or indicia such as initials of the colors: "B" for black, "R" for red, etc. This permits rapid and accurate connection of either type cable to the assembly.

24 Claims, 5 Drawing Sheets

COLOR CODED TELEPHONE PLUG RECEPTACLE

CROSS REFERENCE

Applicant claims the benefit of Provisional Patent Application 60/325,036 filed Sep. 26, 2001.

FIELD OF THE INVENTION

This invention relates to telephone plug receptacles that receive the plugs of telephone sets. More particularly, the invention relates to a color coded plug receptacle for identifying the positions where the wires of a cable are to be connected to the receptacle.

BACKGROUND OF THE INVENTION

Household and business telephone sets require at least a pair of wires leading from the set back to the central telephone facilities, with one wire operating the ringer of the telephone set and the other wire being the communications wire. It is important to make sure that the wires of the telephone set are properly connected to the wires of the cable leading back to the communications center. Because there are so many telephone sets for a typical telephone system, expedient and accurate connection of the sets to the wires of the system is extremely important.

Historically the communications industry color coded the insulation of the wires in a cable in order to make it simpler for the installer to install various telephone plug receptacle assemblies, known as "phone plates" or "jacks." The installer uses the color code of the insulation of the wires of the cable to determine the positions where each wire of the cable is to be connected to the contacts of the phone plate.

An example of this is the older type cable commonly called "station wire" that has four wires in a cable. The insulation for each of the four wires is colored differently: green, red, black and yellow. The four conductor station wire was used in most if not all residential applications. The phone plates having four sockets for receiving the four pins/prongs of a plug also had those same four colors of insulation on the short wires leading from the sockets that received the pins of the plugs to the screw heads of the wire connectors or junctions. To install the phone plate correctly you simply attached the wires of the cable to the screws of the phone plates with the color of each cable wire matching the color of the wire of the screw head. The green cable wire is connected to the screw having a green wire connected thereto, the red cable wire is connected to the screw having a red wire connected thereto, etc. The installation process was simple and self explanatory. Attach the same color of cable wire to the same color of the phone plate wire and the phones in the home worked. Phone plates that are color coded for station wire are still in common use, even though they are not currently being installed.

Later it became necessary to accommodate more complex communication devices, i.e. the "fax," and the more complicated and sophisticated 6-wire systems were created and installed using the same four colors green, red, black, and yellow, and the two added wires were colored white and blue. The keystone jack and plug were developed and provided a smaller and more stable connection between the cable wires and the phone set wires and provided more spaces for additional wires. The six pin phone plate that this cable wire connected to had the appropriate colored wire going from the pins to the screws. Again installation was self explanatory. Match the colors of the cable wires to same colors of the phone plate wires and the six pin plate worked.

Next the 8-Wire system was developed which added wires having brown and white insulation as a pair. As long as the color of the insulation of the wires coming from the cable in the wall matched the color of the insulation of the wires of the phone plates to which they were connected, there was little chance of mismatching. That is the simplicity of the installation system.

An example of the system using this older system of wiring is as follows. This table addresses installation of three devices: An 8 pin/screw phone plate, a 6 pin/screw phone plate and a 4 pin/screw phone plate. We are mostly concerned with the 4 and 6 pin application.

| SCREW* | ISDN 8-WIRE CABLE | ETHERNET 6-WIRE CABLE | TELEPHONE 4-WIRE CABLE Station wire |
|---|---|---|---|
| #1, #2 | Green / Red | Green / Red | Green / Red |
| #3, #4 | Black / Yellow | Black / Yellow | Black / Yellow |
| #5, #6 | White / Blue | White / Blue | |
| #7, #8 | Orange / Brown | — | — |

*The screw had the same color of wire attached to it coming from the pin as the wire that the diagram suggest be attached to the screw.

Later, the industry changed the cable wire that is installed so that in some installations the color of the insulation on the wires of the cable no longer matched the colors of the insulation of the wires of the old station wire phone plates or the colors of the later developed phone plates as shown in the above table. Therefore, the installers no longer have the convenience of simply matching colors to achieve proper connections of wires of newer cables to the older phone plates in all situations. In order to properly install the newer telephone cable to the older phone plates that are color coded for station wire the installer must know how to match different colored wires together. This results in improper installation of wires in many instances.

The industry changed from installing four, six and eight conductor station wire in the colors identified above to category 3 and category 5 cable wire in the residential application. The categories 3 and 5 cables have a different color code so that the wire colors do not match the colors of the short wires of the phone plates. This transition from station wire began around 1997 and still continues. However, station wire is not totally obsolete. Most new homes are wired with category 5 cable today, but there are many older homes that are wired with station wire.

Category 3 cable is available in two, three and four pairs of wires. A pair is two individual wires each bearing color coded insulation and twisted around the other wire of the pair. The pairs, either 2, 3, or 4 pairs, are then collected together and covered with a overall jacket or sheath to form a cable. A three pair cable has six wires. A two pair cable has four wires. A four pair cable has eight wires.

For example, a three pair category three cable has the following individual wire colors: pair one—blue, and white with blue stripe; pair two—orange, and white with orange stripe; and pair three—green, and white with green stripe. The solid colored wires usually are paired with the white wire that bears a stripe that is the same color as the solid color wire. The following table outlines the different colors of wires in a cable.

| | ISDN (Category 5 Cable) 8-WIRE CABLE/ 4 Pair Wire | ETHERNET (Category 3 Cable) 6-WIRE CABLE/ 3 Pair Wire | TELEPHONE (Station Wire) 4-WIRE CABLE/ 2 Pair Wire |
|---|---|---|---|
| Pair 1 | Blue<br>White/Blue | Blue<br>White/Blue | Green/Red |
| Pair 2 | Orange<br>White/Orange | Orange<br>White/Orange | Black/Yellow |
| Pair 3 | Green<br>White/Green | Green<br>White/Green | Black/Yellow |
| Pair 4 | Brown<br>White/Brown | — | — |

The problem is that the phone plates commonly used and available for residential construction have the old station wire colors attached to the pins leading to the screws but the cable that is installed throughout the house is likely to be the newer category 3 or category 5 cable which has different colored individual wires than station wire of the phone plate. When connecting phone plates to category 3 and category 5 cable, the installer can no longer simply attach the cable wires to matching colors of the wires of the phone plate. This requires the installers to develop their own installation procedures when connecting the category 3 or category 5 cable to the phone plate.

In an example of connecting phone plates with a four pin/screw phone plate to category 5 cable, the installer could connect the blue wire to the screw with the green wire going to the pin , then connect the white wire with blue stripe wire to the screw with the red wire going to the pin, then connect the orange wire to the screw with the black wire going to the pin, then connect the white with orange stripe wire to the screw with the yellow wire going to the pin. The remaining two pairs of the category 5 cable would not be connected in this application. As long as this color combination was used throughout the house the phone system would work.

The problem is that there may be several different installers working on the house at different times, all with different levels of experience. If any of the installers mistakenly connect a phone plate differently than the previous example that phone plate will not work. Looking back at the previous example, if an installer connected the blue wire to the screw with the black wire going to the pin and the rest of the house was wired as described above, that phone plate would not work. When the home owners moved in they likely would call the installer and the installer would have to return to the job and reconnect that particular phone plate correctly. This costs money and time for the installer. This happens virtually all the time in the industry and is a major complaint of installation contractors. The installers usually do not like installing the phone systems because it is too confusing.

One solution is the "Keystone" system that uses the idea of a plug which when wired correctly will simply plug into the phone plate and the devices may be run off of the correctly wired system. This is accomplished by using a device that has a series of slots on the back that match the color coding of the new category wires. By using a device to force each wire into it's proper slot, one can wire the Keystone device to work properly. The problem is that not all houses are wired with the costly Keystone devices or the even more costly switch box or boxes.

The Keystone devices are 8 pin devices which aid the user to run multiple tasks from one phone plate. Not all phone plates need to be that sophisticated or costly. Therefore, if the end user wishes to use a computer, a fax machine and a telephone at the same time, he or she can do so with this device wired properly. For example a single extension phone in another room does not need the Keystone device or eight pin phone plate. This means that most contractors in a residential setting use the standard phone plates as described above.

SUMMARY OF THE INVENTION

The solution to the problem where a building has been wired with category 3, category 5 or even category 6 wiring and the technician wishes to install a standard four, six or eight pin phone plate/wall jack, is to color code the phone plate/wall jack's wires to match the colored pairs of wires of the cable. This makes it easier to install the required phone plates at remote locations throughout the premises. That is to say, the short wires affixed to the phone plates at the factory or assembly point will be color coded to match the category 3, 5 and 6 cabling. Not all the wires of the category 5 or 3 wiring insulation are necessary in every phone plate as will be shown below.

This new color coding of the wires on the back of standard phone plates solves a major problem in the installation process of new home phone systems. Simply match the colors and it works. An unskilled installer could do this with little training.

Therefore the installation process would be as follows: The brown wire of the cable is connected, as with screws, clamps, twists solder or other conventional connectors, to the brown wire of the phone plate, and the white with brown stripe wire of the cable is similarly connected to the white with brown stripe wire of the phone plate. The blue wire of the cable is similarly connected to the blue wire of the phone plate, and the white with blue stripe wire of the cable is similarly connected to the white with blue stripe wire of the phone plate. The green wire of the cable is similarly connected to the green wire of the phone plate, and the white with green stripe wire of the cable is similarly connected with the white with green stripe wire of the phone plate. The orange wire of the cable is similarly connected to the orange wire of the phone plate, and the white with orange stripe wire of the cable similarly connected to the white with orange stripe wire of the phone plate.

Another way of stating it is that the solid colored wires of a cable are matched with wires of the phone plate having the same solid colors and the white wires with colored stripes of the cable are matched with white wires having the same color stripe on the phone plate. This solves the problem for new installations using category 3 or category 5 cable.

However, this does not solve the problem when the same type phone plate is to be used to connect to station wire cable that has the old color combination of wires.

In order to solve the color code mismatch described above when installing a phone plate without the proper color code, I have developed a color code system that is compatible with cables having different color codes, for example, both categories 3 and 5 cable and with station wire cable. The different colored wire insulation is used on the short wires of the phone plates as described above for one of the cable color systems, such as the category 3 and category 5 cables, and in addition the phone plate itself is color coded for the other type of cable, such as the station wire. This places both color code systems on the phone plate so that the installer has access to both color codes of the cables when installing each phone plate.

For example, the insulation of the short wires of the phone plate can bear the color code of the categories 3 and 5 cable and the screws of the phone plate can bear the colors of the station wire. When connecting station wire cable to the phone plate, the installer would match the station wire colors of the cable with the colors of the screws. This means that while the station wire colors of the cable would match the colors of the screw connectors, they would not match the colors of the short wires of the phone plate. When installing category 3 or 5 cable, the colors of the cable wires would match the colors of the short wires of the phone plate but not the colors of the screw connectors.

Another example is that instead of color coding the screws of the phone plate, the material of the phone plate can bear the color code in positions closely associated with the screws.

Another example is, instead of using colors on the phone plate or on the connector screws, the phone plate and/or the screws can be marked with letters or other indicia that indicates color, such as "G" for the color green, "R" for the color red, "Bk" for the color black, "Y" for the color yellow, "W" for the color white, "Bu" for the color blue, "O" for the color orange, and "Br" for the color brown. The colored wires of the cable would be connected to the connector adjacent the indication for the same color.

Yet another coding of the phone plate is to use a combination of colors on or adjacent the connector screws to designate white with a colored stripe. An example is to use screws bearing both a white or neutral color and another color to indicate white wire with a colored stripe. This same type of color combination can be directly applied to the phone plate itself instead of to the screw connectors.

Also, instead of using colors, the designations W/G for white wire with a green stripe, "W/R" for a white wire with a red stripe, etc. can be applied to the phone plate adjacent a screw connector for indicating white wire with green stripes or white wire with red stripes, etc.

A major advance is provided in the above noted examples in that it is simpler and easier to correctly match up the cable wires to their appropriate mates on the phone plate without mistake because the wires placed on the phone plate bear the same color code as the new cables and the screw connectors or the phone plate itself is color coded for the station wire. This makes the device simpler and faster to install, virtually fool proof for the installer who is not fully trained. There are no special tools or other devices necessary for installation, and the cost of the device is economical.

DETAILED DESCRIPTION

Figure 3:
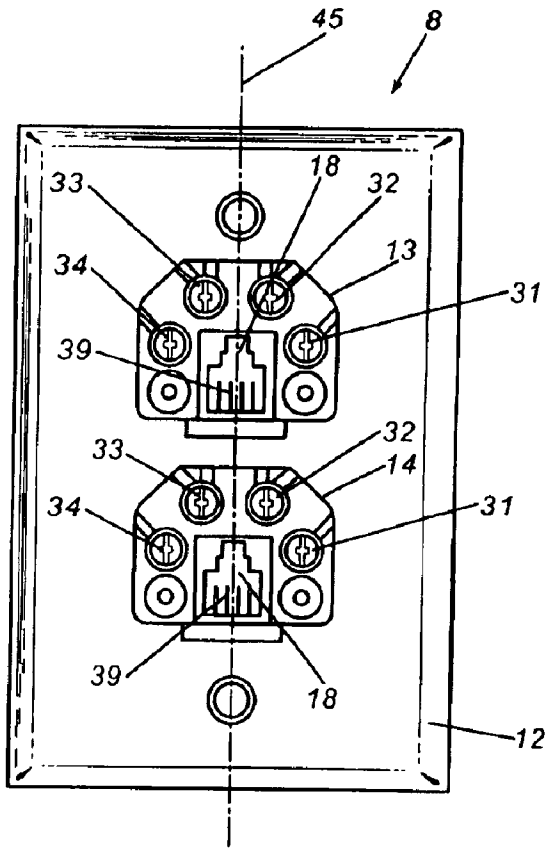
FIGS. 1–3 illustrate a telephone plug receptacle assembly or phone plate having two jacks, with each jack arranged for accepting the plug of a four wire two pair cable, with FIG. 1 being a side view, FIG. 2 being a front view, and FIG. 3 being a rear view.
Figure 2:
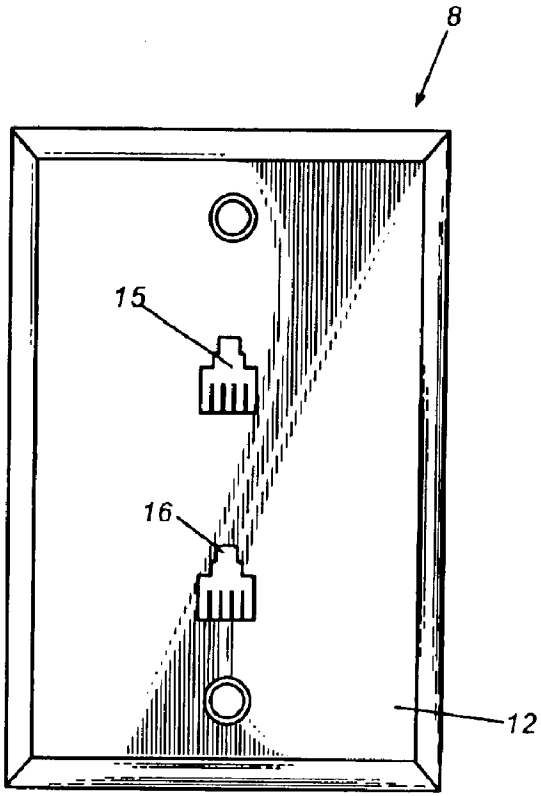
Figure 1:
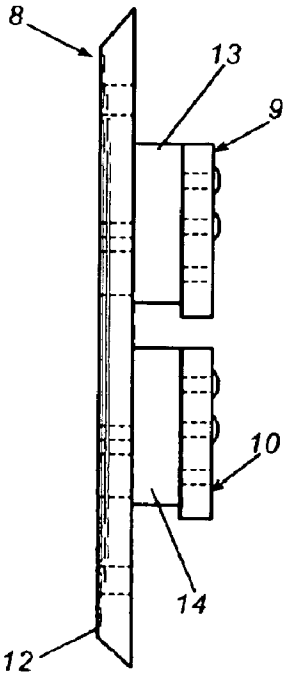

Referring now in more detail to the drawings, in which like numbers refer to like features throughout the several views, FIGS. 1–3 illustrate a telephone plug receptacle assembly or phone plate 8 that includes two jacks 9 and 10. The receptacle includes a wall plate 12 and the jacks are formed by a pair of mounting blocks 13 and 14 mounted to the phone plate by means of a sliding tongue and groove fit or by other conventional connecting means. As best shown in FIG. 2, the wall plate 12 includes plug openings 15 and 16 for receiving conventional keystone plugs of a telephone set or of other equipment that is to communicate with sound and/or video equipment.

As shown in FIG. 3, the mounting blocks 13 and 14 are duplicates, with each including a socket 18 for receiving a plug 20 (FIG. 11) of a telephone set, etc. The socket is open-ended, with the open ends facing fore and aft of the mounting block, so as to receive the telephone plug 20 from one direction and the wire positioning block 22 (FIG. 10) from the other direction.

As shown in more detail in FIGS. 10–13, the four wire, two pair telephone cable 24 has its insulated wire conductors 25–28 extending from a sheath 30. The mounting block 13 has junctions in the form of screws 31–34 threadedly mounted into openings (not shown) of the mounting block. Likewise, a plurality of short insulated wire conductors 35–38 have one of their ends 35*a*–38*a* extending through the wire positioning block 22 and into the socket 18 of the mounting block 13. The ends of the short wires are bare, having no insulation, so that the ends 39 form the connector pins for engaging the conductors of the plugs. The opposed or other ends of each short insulated wire conductor is joined to one of the junctions 31–34.

Figure 10:
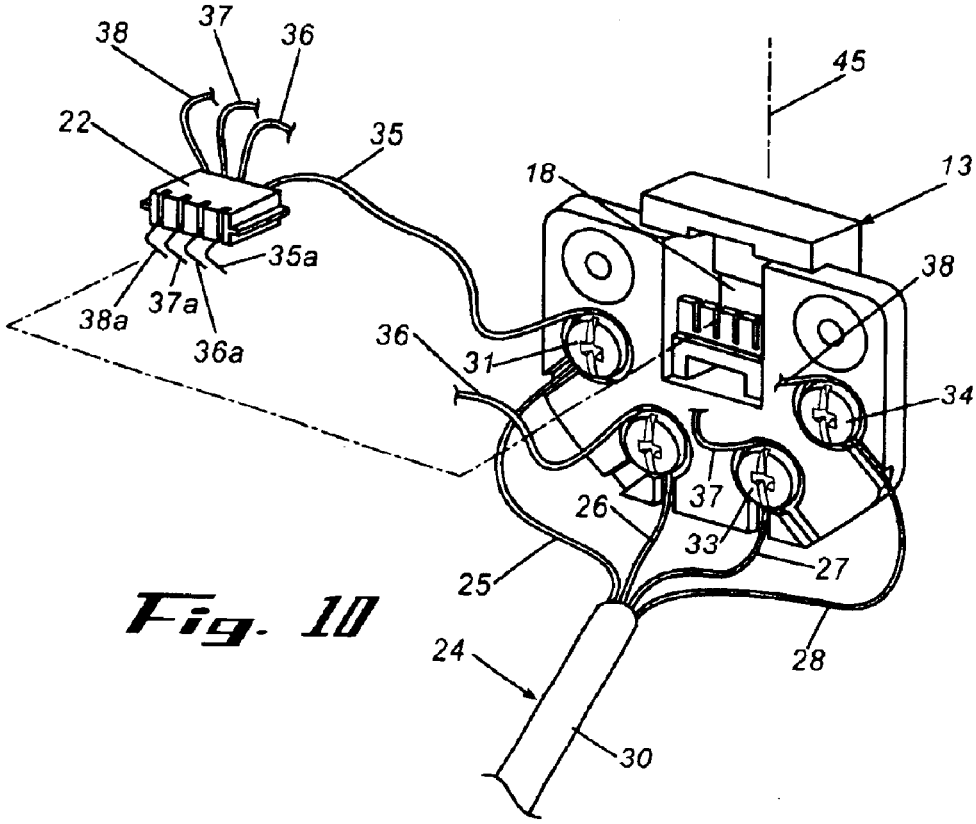
FIG. 10 is a rear perspective, exploded view of a mounting block of a telephone plug receptacle assembly for receiving a four wire two pair cable, showing the ends of the conductors and the wire positioning block removed from the rear of the plug.
Figure 11:
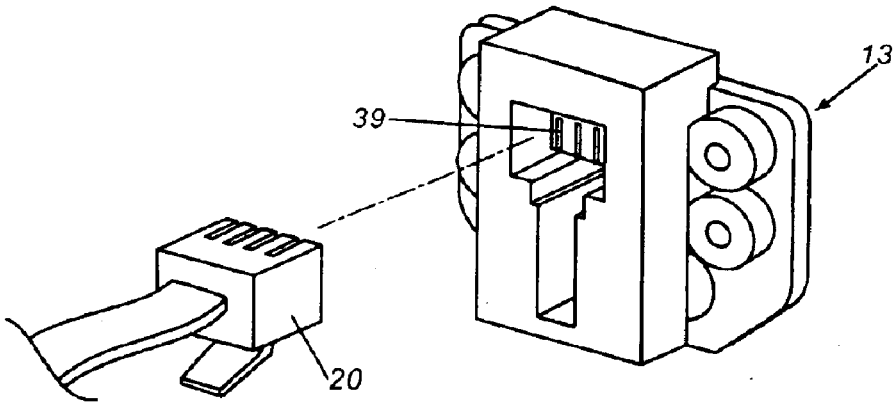
FIG. 11 is a front perspective illustration of the same four wire two pair mounting block, showing the wire positioning block placed in the plug, and a conventional telephone plug displaced from the socket.
Figure 12:
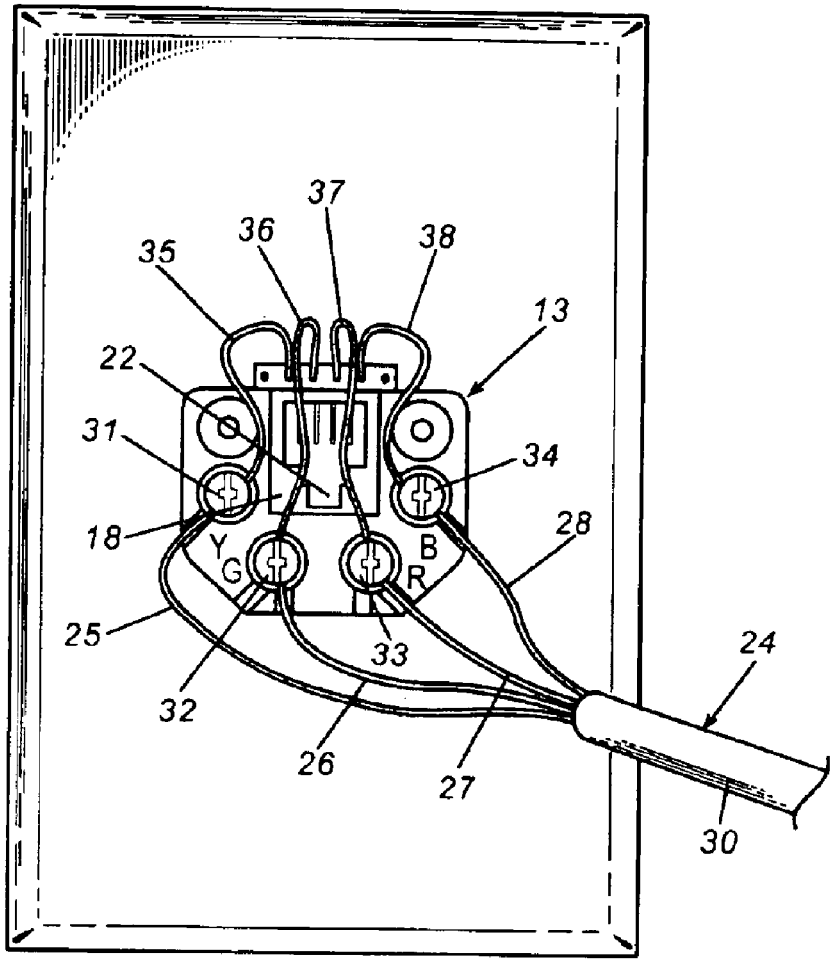
FIG. 12 is an enlarged front view of a phone plate, showing the color code applied to the mounting block of the phone plate.

In the embodiment illustrated in FIGS. 10 and 12, which is a four wire cable, the four wires of the cable are arranged in pairs, with the wires of each pair of wires usually twisted together along their lengths inside the sheath 30. One wire of a pair is used for one function, such as for actuating the ringer of the telephone, and the other wire of the pair is used for another function, such as to transmit message signals. It is important that the ringer wire and the message wire of the cable be connected to the correct ringer wire and message wire of the phone plate. This same arrangement is carried on through the telephone plug that leads between the set and the communications center.

In order to make sure that the wires of the telephone cable are correctly matched by the installer with the corresponding wires of the phone plate, the cable wires are color coded with distinctive colors and the phone plate bears a corresponding color code. The cable wires and the phone plate wires are color coded to match each other. The insulation jackets of each wire conductor of the phone plate bear a distinctive color or color combination that match the colors and color combinations of the wires of one type telephone cable, while each junction of the phone plate have a color identification that matches the colors or color combination of the wires of another type cable.

For example, one wire 27 of a pair of wires of the cable is formed of a solid color blue and another wire 25 of the other pair of wires is formed of the solid color orange. The second wire of the first pair of wires is white or other light color that contrasts with the solid color, and dark colored blue stripes are formed on the light color. The blue stripe is a color that matches the solid blue color of the other wire in the pair of wires. Likewise, the other second wire of the second pair of wires of the cable is white and a dark colored orange stripe is formed on the light color. These same color combinations would be present on the four wires of the phone plate. With this arrangement, the telephone installer simply matches colors of the wires of the cable with the wires of the phone plate to accurately connect them. For example, referring to FIG. 10, if the insulation jacket of the cable wire 27 is a solid color blue and the insulation jacket of the plug wire 37 is a solid color blue, the installer connects blue cable wire 27 to junction 33, where blue plug wire 37 has already been connected. The installer will also connect cable wire 26 which has an insulation jacket that is light background with a blue stripe to the junction 32 that is already connected to plug wire 36 that is of a matching color combination.

Likewise, solid orange insulation wire 25 of the cable will be connected to junction 31 where solid orange short wire 35 is connected, and the cable wire 28 having light background and orange stripe insulation will be connected to junction 34 where the short wire 38 also with insulation of light background and orange stripe is connected.

As shown in FIG. 12, the junctions 31–34 are also color coded in colors that correspond to the color code of the wires of a second type of phone cable. For example if the second type cable is station wire, the junctions 31–34, which are disclosed as screws, are color coded with the same colors of the station wire: red, green, black and yellow. In the alternative, the mounting block can be marked with indicium such as "R" for red, "G" for green, "B" for black, and "Y" for yellow. Or the colors and color combinations of the cable can be directly applied to the mounting block (not shown).

Figure 6:
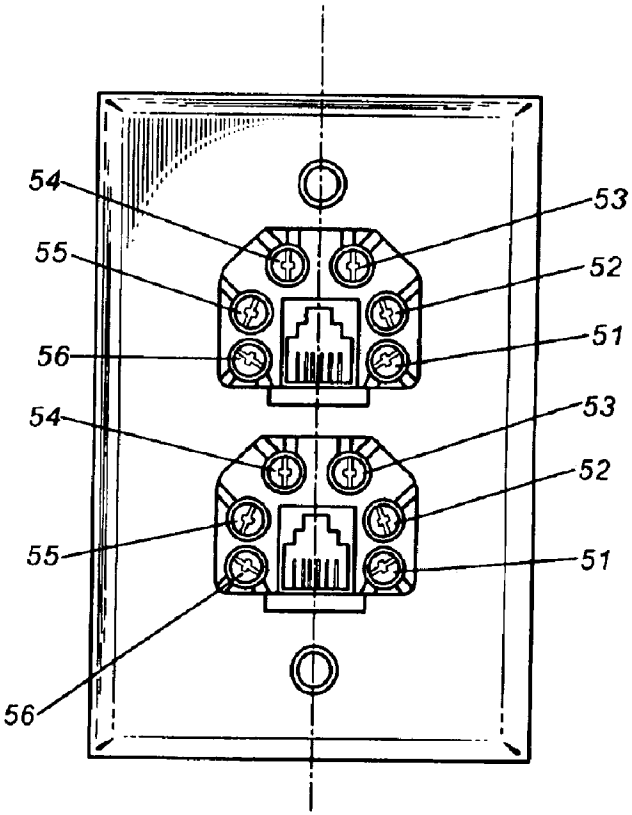
FIGS. 4–6 illustrate a telephone plug receptacle assembly having two jacks, with each jack arranged for accepting the plug of a six wire three pair cable, with FIG. 4 being a side view, FIG. 5 being a front view, and FIG. 6 being a rear view.
Figure 9:
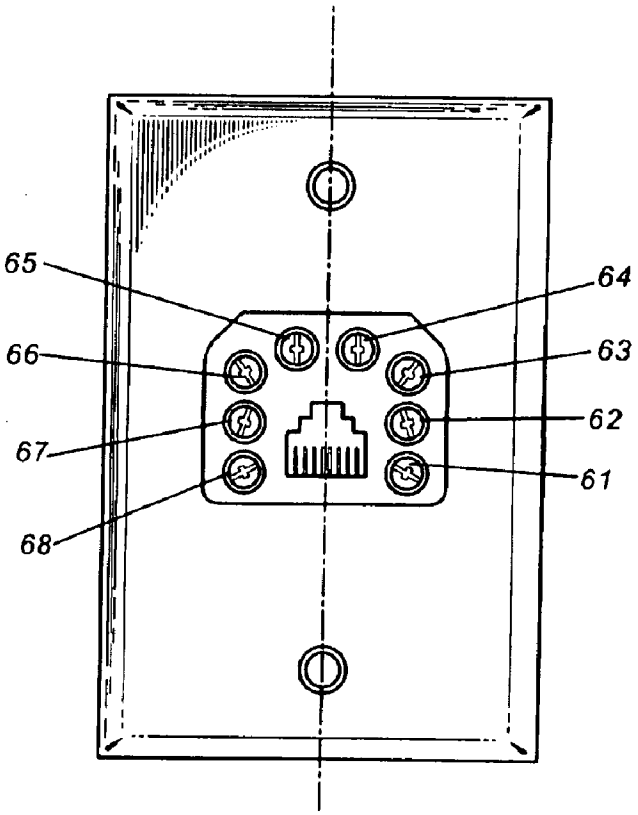
FIGS. 7–9 illustrate a telephone plug receptacle assembly having one jack, with the jack arranged for accepting the plug of an eight wire four pair cable, with FIG. 7 being a side view, FIG. 8 being a front view, and FIG. 9 being a rear view.

It should be noted that the junctions 31–34 are arranged in a U-shaped array, around a central axis 45, with one-half of the junctions on one side of the axis and the other half of the junctions on the opposite side of the axis, and the plug wires of each pair of plug wires are connected to junctions on opposite sides of the axis. This is another way of simplifying the installation procedures for the installer, so that the installer will always know to connect the solid color cable wire on one side of the axis and the corresponding striped color cable wire on the opposite side of the axis. Moreover, the mounting blocks of FIGS. 3, 6 and 9 are assembled at the production facilities with the blue wires at the bottom of the U-shape, the orange wires next for a four wire receptacle, the green wires next for a six wire receptacle and the brown wires next for an eight wire receptacle. The installer typically starts with the junctions 32 and 33 which are at the base of the U and closer to the axis 45, so that a logical progression of wire connection is achieved about the U-shaped arrangement of junctions.

Figure 5:
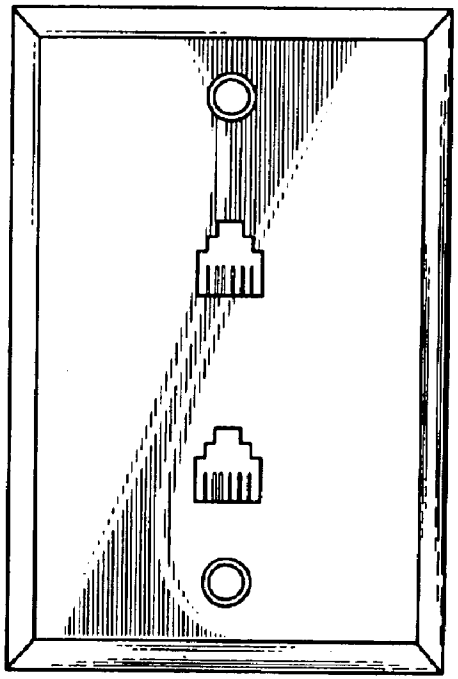
Figure 4:
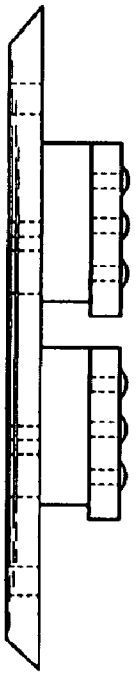

While FIGS. 1–3, and 10–12 relate to a four wire, two pair cable and phone plate arrangements, FIGS. 4–6 show a six wire, three pair arrangement for its phone plates. The color combinations can be applied as describe above.

For example, FIG. 6 shows screws 51–56 for each jack that function as junctions. Insulated wires from a six wire cable are to be connected to junctions 51–56 of each jack. The cable and plug wires leading to and from junction 54 would be solid color blue and the wires leading to and from junction 53 would be a light color background with a blue stripe. The wires leading to and from junction 52 would be the solid color orange and the wires leading to and from junction 55 would be a light color background with an orange stripe. The wires leading to and from junction 51 would be solid color green and the wires leading to and from junction 56 would be a light color background with a green stripe. This matches the color code of a category 3 cable. While this describes the colors for category 3 cable the junctions 51–56 would be color coded for another type of cable, such as station wire.

Figure 8:
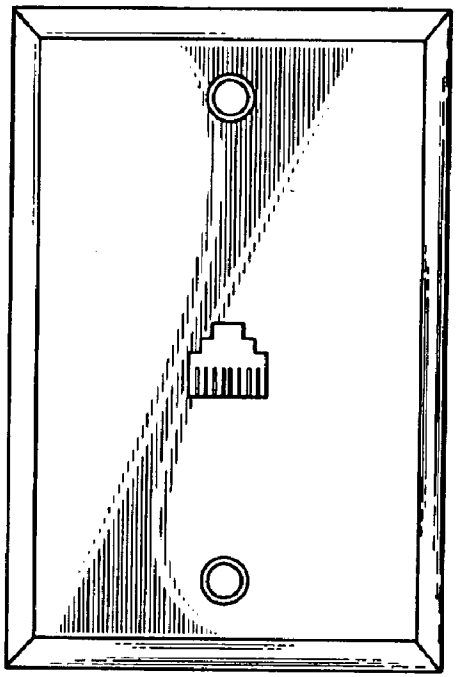
Figure 7:
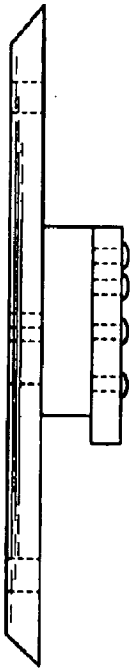

FIGS. 7–9 show an eight wire, four pair phone plate for receiving the wire conductors of an eight wire, four pair cable. The screws 61–68 function as junctions for connecting the cable wires to the plug wires. For example, the wires leading to and from junction 65 would have a solid color blue insulation, whereas the insulation of the wires leading to and from junction 64 would have a light color background and a blue stripe. The wires leading to and from junction 63 would have a solid color orange insulation, whereas the wires leading to and from junction 66 would have a light background with an orange stripe. The wires leading to and from junction 62 would have a solid green insulation, whereas the wires leading to and from junction 67 would have insulation with a light background and a green stripe. The wires leading to and from junction 61 would have a solid color brown insulation, and the wires leading to and from junction 68 would have a light color insulation with a brown stripe. This matches the color code for category 5 cable. The junctions can be color coded for another type cable, such as station wire.

Again, it will be noted that the solid color wires are placed on one side of the axis of the U-shaped array of junctions, whereas the matching wire would be placed on the opposite side of the axis, and the wires would be connected progressively from the base of the U-shape toward the ends of the U-shape.

Although preferred embodiments of the invention have been disclosed in detail herein, it will be obvious to those skilled in the art that variations and modifications of the disclosed embodiment can be made without departing from the spirit and scope of the invention as set forth in the following claims.

What is claimed is:

1. A telephone plug receptacle assembly for receiving a plug of a transmitter/receiver and for receiving color coded wires of telephone cables with the wires of a first cable bearing a different color code than the wires of a second cable, comprising:

a mounting block, said mounting block defining a socket for receiving a keystone plug of a receiver/transmitter, a wall plate for attaching said plug receptacle to a wall of a building structure and defining a plug opening extending therethrough, said mounting block and said wall plate attached to each other with said socket of said mounting block in alignment with said plug opening of said wall plate, said mounting block including a plurality of electrically conductive junctions, said junctions arranged in a U-shaped array with a center axis extending through said U-shape with one half of the junctions on one side of said center axis and the other half of said junctions on the other side of said center axis, a plurality of mounting block wire conductors each having a first end and a second end, said first ends of said mounting block wire conductors extending through said socket of said mounting block for registering with the electrical conductors of a plug received in said socket, each of said mounting block wire conductors extending from said socket to one of said junctions with said second end of each said mounting block wire conductor joined to one of said junctions, each of said mounting block wire conductors having intermediate its ends an insulation jacket of a different color from the colors of the insulation jackets of the other mounting block wire conductors, with said insulation jackets each corresponding in color with a color of one of said wires of the first cable, the mounting block wire conductors of each of said pairs of conductors joined to junctions on opposite sides of said center axis of said U-shaped array of junctions, with a first pair of mounting block wire conductors connected to the junctions at the base of the U-shape, and the second and subsequent pairs of mounting block wire conductors each connected in sequence to next adjacent junctions about the U-shaped array of junctions, said junctions each bearing color identification that corresponds with the color of one of said wires of said second cable.

such that the wires of the first cable will be matched in color with the wire conductors of the plug receptacle bearing the same color, or the wires of the second cable will be matched in color with the junctions identified with the color of the wires of the second cable.

2. The telephone plug receptacle assembly of claim 1, wherein the insulation jacket of a conductor of each pair of conductors is a solid color and the insulation jacket of the other conductor of the pair of conductors is of a common color with a stripe of a color that is the same as the solid color of the other wire of the pair.

3. A telephone plug receptacle assembly for receiving a plug of a transmitter/receiver and for receiving color coded station wire or color coded category 3 and 5 wire, comprising:

a mounting block defining a socket and a plurality of junctions, a wall plate defining a plug opening, a mounting connection that holds said mounting block and said wall plate together with said socket aligned with said plug opening, a plurality of wire conductors, each having first and second opposed ends and each having an insulated jacket intermediate its ends, said wire conductors arranged in pairs and each having their first ends extending through said socket for connection to wires of a plug and their second ends connected to one of said junctions, said insulated jackets of the wire conductors bearing colors that correspond to the colors of category 3 cable colors and the junctions bearing color identification that correspond to the colors of station wire.

4. The telephone plug receptacle assembly of claim 3, and wherein said wire conductors bear colors that correspond to the colors of both category 3 cable and category 5 cable.

5. The telephone plug receptacle assembly of claim 4, wherein said color identification of each junction is a screw bearing a color.

6. The telephone plug receptacle assembly of claim 4, wherein said color identification of each junction is applied to said mounting block at a position that identifies a junction.

7. The telephone plug receptacle assembly of claim 6, wherein said color identification of each junction is at least one indicium that identifies a color.

8. A telephone plug receptacle assembly for receiving a plug of a transmitter/receiver and for receiving the wires of telephone cables with the wires of a first cable bearing a different color code than the wires of a second cable, said plug receptacle including a plurality of conductors each having a first end and a second end, a junction for each of said conductors, said first ends of each conductor connected to one of said junctions and the second ends of each conductor adapted for connection to a plug, each said conductor bearing at least one solid color or a color combination that is different from the solid colors and color combinations of the other conductors so that each conductor can be visually distinguished from the other conductors, with the solid color conductors and color combination conductors matching the colors of the wires of the first cable, said junctions each being identified by colors different from the colors of the other junctions and matching the colors of the second cable, such that the wires of the first cable will be matched in color with the conductors and the wire of the second cable will be matched in color with the junctions.

9. The telephone plug receptacle assembly of claim 8, wherein said junctions are screws.

10. The telephone plug receptacle assembly of claim 8, wherein said conductors are clad in an insulation, and wherein the color borne by the conductor is borne by said insulation.

11. The telephone plug receptacle assembly of claim 10, wherein said conductors are wire conductors.

12. A telephone plug receptacle assembly for receiving the wire of category 3 and category 5 telephone cable and the wire of telephone station wire comprising:

a plurality of conductors each having a first end and a second end, a plurality of junctions, said first end of each said conductor connected to one of said junctions and said second end of each said conductor adapted for connection to a plug, each of said conductors bearing a different color or color combination than the other said conductors so that they are visually distinguishable from all of the others of said conductors, with the colors and color combinations of said conductors matching the colors and color combinations of the wires of category 3 and category 5 telephone cable, and said junctions identified with colors of telephone station wire.

13. The telephone plug receptacle assembly of claim 12, wherein said conductors are clad with insulation, and said insulation bears said colors.

14. The telephone plug receptacle assembly of claim 12, wherein said conductors are wire.

15. The telephone plug receptacle assembly of claim 12, wherein said junctions are identified by the colors black, red, green and yellow.

16. The telephone plug receptacle assembly of claim 12, wherein said conductors bear the colors blue, white and blue, orange, white and orange, green, white and green, brown, white and brown.

17. A telephone plug receptacle assembly for receiving the wires of category 3 and category 5 telephone cable as well as station wire cable, comprising:

a plurality of conductors with each conductor having a first end and a second end, a junction for each conductor, the first end of each said conductor connected to one of said junctions and the second end of each said conductor adapted for connection to a plug, said conductors each being visually marked with color identification corresponding to the colors of the wires of category 3 and category 5 telephone cable so that the wires of the category 3 and category 5 cable can be visually matched with said conductors, said junctions each being visually marked with color identification corresponding to the colors of the wires of station wire cable so that the wires of the station wire cable can be visually matched with said junctions.

18. The telephone plug receptacle assembly of claim 17, wherein the visual marking of said junctions is indicia.

19. The telephone plug receptacle assembly of claim 17, wherein the visual marking of said junctions is color.

20. The telephone plug receptacle assembly of claim 17, wherein said junctions are screws, and said screws each bear a different color that corresponds to a color of a wire of said second cable.

21. A telephone plug receptacle assembly for receiving a plug of a transmitter/receiver and for receiving the color coded wires of telephone cables with the wires of a first cable bearing a different color code than the wires of a second cable, said plug receptacle including a plurality of conductors each having a first end and a second end, a junction for each of said conductors, said first ends of each conductor connected to one of said junctions and the second ends of each conductor adapted for connection to a plug, each said conductor being identified by a color that is different from the color of each of the other conductors so that each conductor can be visually distinguished from the other conductors, with the color of each conductor matching the color of one of the wires of the first cable, each said junction being identified by a color that is different from the color of each of the other junctions so that each junction can be visually distinguished from the other junctions, with the color of each junction matching the color of one of the wires of the second cable, such that the wires of the first cable will be matched in color with the color of the conductors and the wires of the second cable will be matched in color with the color of the junctions.

22. The telephone plug receptacle assembly of claim 21, wherein the color identification of said junctions is indicia.

23. The telephone plug receptacle assembly of claim 21, wherein the color identification of said junctions is color.

24. The telephone plug receptacle assembly of claim 21, wherein said junctions are screws.

* * * * *